US007546935B2

(12) United States Patent
Wheaton

(10) Patent No.: US 7,546,935 B2
(45) Date of Patent: Jun. 16, 2009

(54) DISPENSING VALVE ASSEMBLY FOR A BEER KEG

(75) Inventor: Christopher Simon Courtenay Wheaton, Hereford (GB)

(73) Assignee: Cypherco Limited (GB)

( * ) Notice: Subject to any disclaimer, the term of this patent is extended or adjusted under 35 U.S.C. 154(b) by 697 days.

(21) Appl. No.: 10/513,182

(22) PCT Filed: Apr. 30, 2003

(86) PCT No.: PCT/GB03/01860

§ 371 (c)(1),
(2), (4) Date: Jun. 20, 2005

(87) PCT Pub. No.: WO03/093163

PCT Pub. Date: Nov. 13, 2003

(65) Prior Publication Data

US 2006/0054643 A1 Mar. 16, 2006

(30) Foreign Application Priority Data

May 2, 2002 (GB) ..... 0210039.4

(51) Int. Cl.
*B65D 83/00* (2006.01)

(52) U.S. Cl. ..... 222/400.7; 137/212

(58) Field of Classification Search ..... 222/400.7, 222/400.8, 203, 303, 153.01, 153.03, 153.09; 217/106, 108, 99–101; 137/212, 320–322; 251/149.6

See application file for complete search history.

(56) References Cited

U.S. PATENT DOCUMENTS 3,672,390 A * 6/1972 Gravesteijn ..... 137/212

(Continued)

FOREIGN PATENT DOCUMENTS

EP 0 761 555 A1 3/1997

(Continued)

OTHER PUBLICATIONS

International Search Report mailed Aug. 19, 2003, in parent International Application No. PCT/GB03/01860.

*Primary Examiner*—Lien T Ngo
(74) *Attorney, Agent, or Firm*—Andrus, Sceales, Starke & Sawall, LLP

(57) ABSTRACT

A dispensing valve assembly for a beer keg comprises a body (11) having a pair of flexible legs (24) which form non-pivotal projection means when splayed outwardly by locking means (14) fixed on a valve stem (12) which is biased sealingly to engage a valve seat (32) of the body (11). The valve stem (12) has an internal valve seat against which is biased a plug (33). In a first position of the locking means (24), when the valve stem is off its valve seat (32), the legs (24) are unsplayed and can pass through an opening of the beer keg, whilst once the valve assembly is thereafter engaged in the beer keg the locking means are allowed to move under spring means (45) to splay the legs outwardly and prevent removal of the assembly from the keg. A special insertion tool is provided to hold the valve stem off its valve seat, and thus the locking means in its first position, prior to assembly of the valve in the beer keg, removal of the tool thereafter allowing the locking means automatically to move to its second position.

23 Claims, 3 Drawing Sheets

U.S. PATENT DOCUMENTS 3,939,860 A * 2/1976 Golding ..... 137/212
4,685,598 A * 8/1987 Nezworski ..... 222/400.7
5,242,092 A * 9/1993 Riis et al. ..... 222/400.7
5,653,253 A * 8/1997 Larsen ..... 137/315.01
5,833,098 A * 11/1998 Gomi ..... 222/400.7
6,367,660 B1 * 4/2002 Chang ..... 222/153.09

FOREIGN PATENT DOCUMENTS

GB 2 331 294 A 5/1999
GB 2 335 654 A 9/1999

* cited by examiner

DISPENSING VALVE ASSEMBLY FOR A BEER KEG

The present invention relates to a valve assembly for controlling fluid flow from a pressurised fluid container, and in particular to a valve assembly for controlling discharge of liquid from a beer keg.

At its discharge opening a beer keg normally has a neck which is threaded or has some form of lug mechanism, and a valve assembly for controlling liquid flow from the keg is inserted into the neck and either screwed in or locked respectively. Beer kegs are pressurised usually to about 3.2 bar and with known valve assemblies it is possible for any person to attempt to withdraw the valve assembly and for it then to fly out of the neck of the keg due to, said internal pressure. Injury can thus result to the person tampering with the valve assembly.

An object of the invention is to overcome this problem.

According to the invention a valve assembly comprises a body adapted to be engaged in an opening in a container, a valve seat, a closure member biased into engagement with said valve seat to prevent fluid flow, in use, past the valve seat, and being movable against said bias to permit such flow, and locking means movable from a first position, in which it is disposed before engagement of the body in said opening in the container, in use, to a second position once such engagement has occurred, and in which second position of said locking means non-pivotable projection means prevent passage of the valve assembly through said opening.

Preferably the projection means is separate from the locking means, and more preferably is at least a part of the body which is splayed outwardly by movement of said locking means to its second position. Desirably a pair of diametrically opposed flexible legs of the innermost end of the body in the container, in use, is dilated by said locking means to form said projection means. Conveniently said valve seat is at one end of a valve stem which fixedly carries said locking means, and advantageously said valve stem is biased sealingly to engage with a valve seat of the body. More preferably said valve stem is held off said valve seat of the body against said bias in said first position of the locking means, and sealingly engages with said valve seat of the body in said second position of the locking means.

Figure 1:
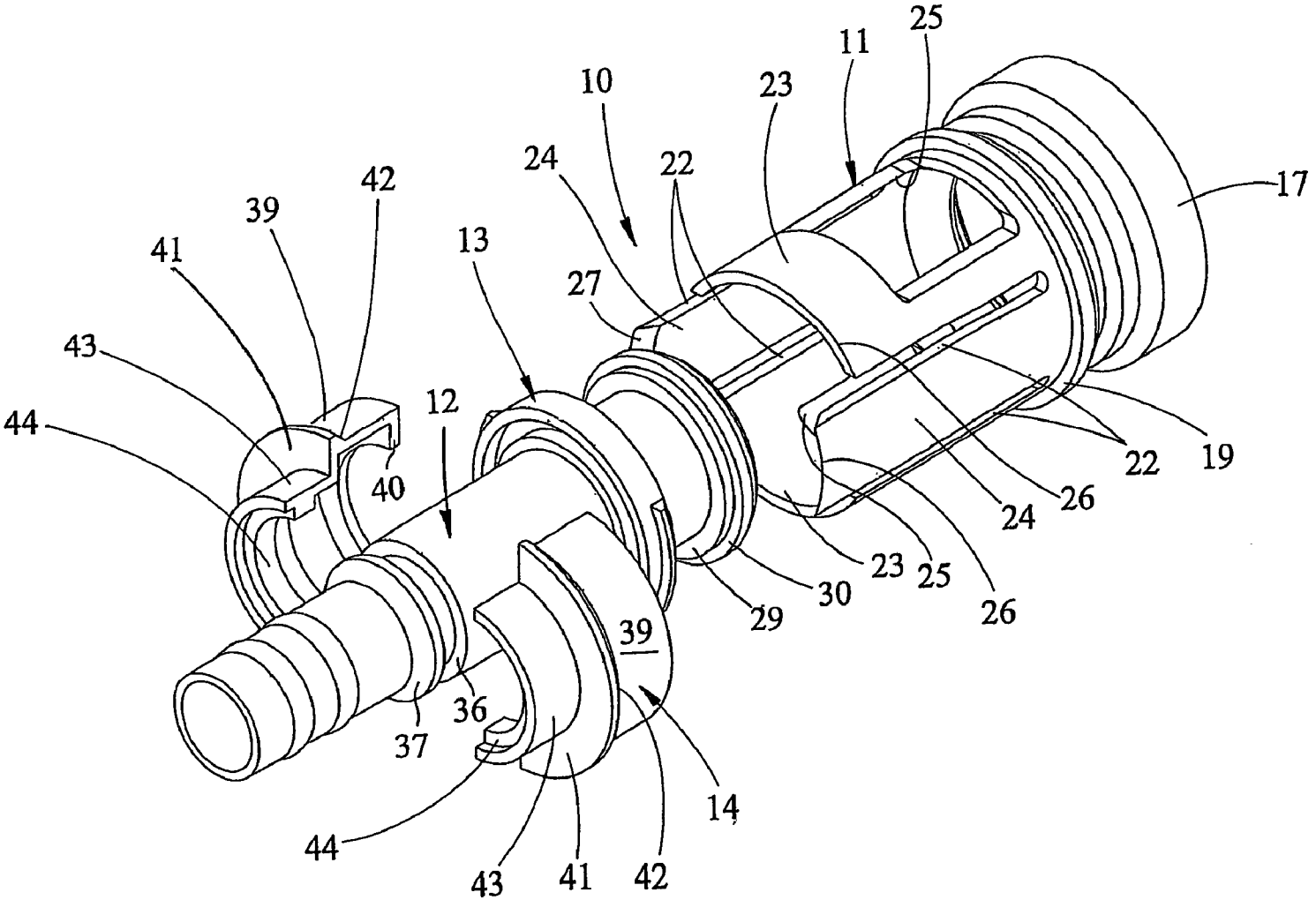
Figure 2:
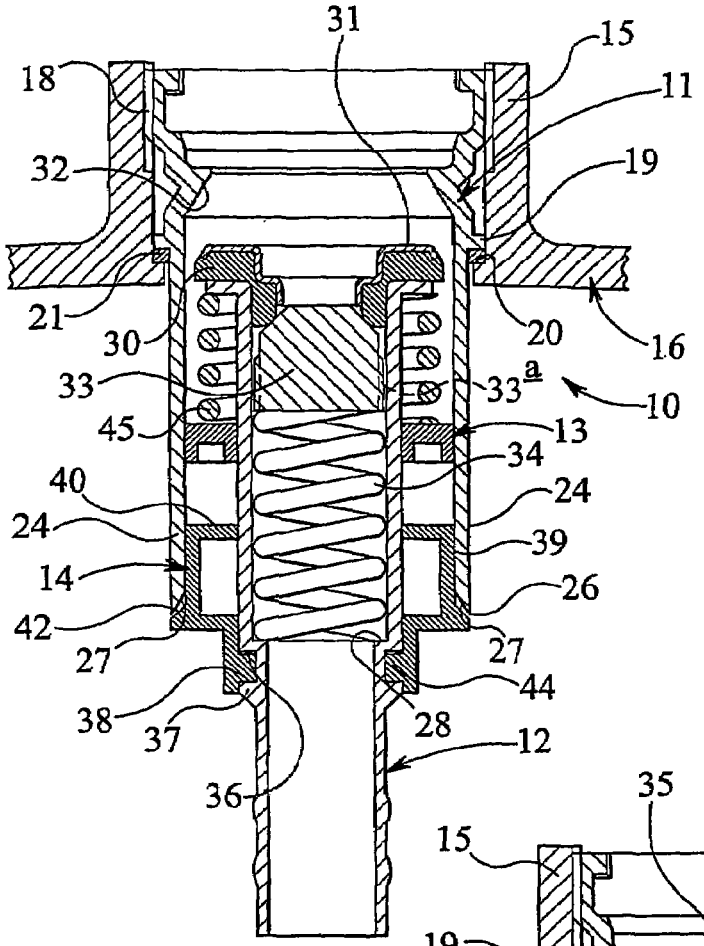
Figure 3:
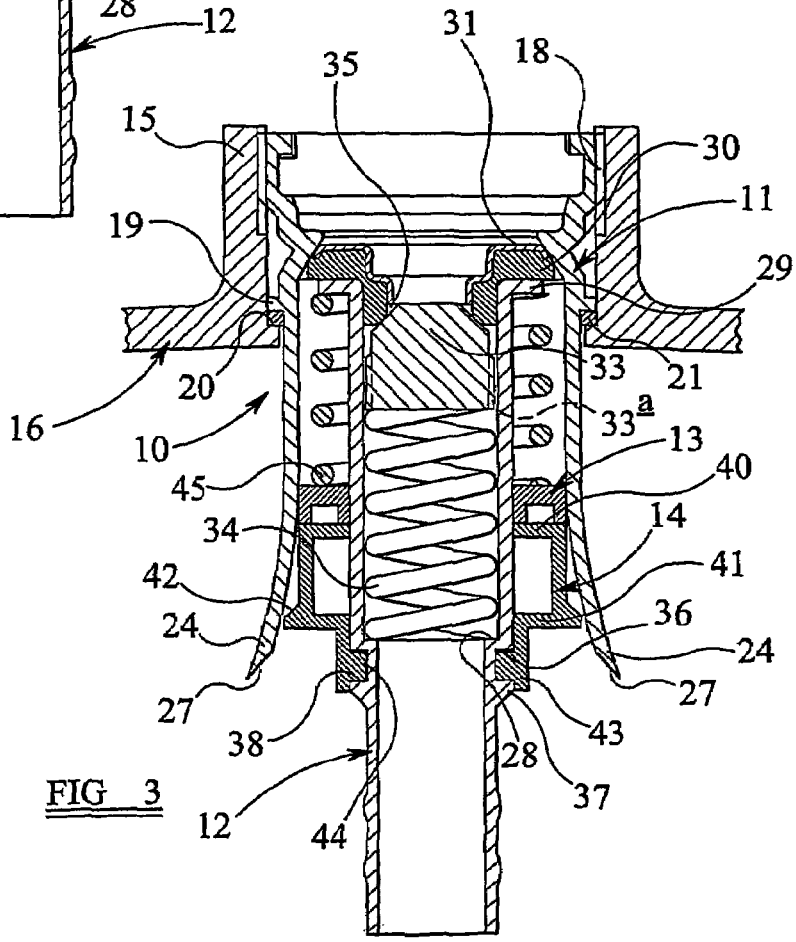
Figure 4:
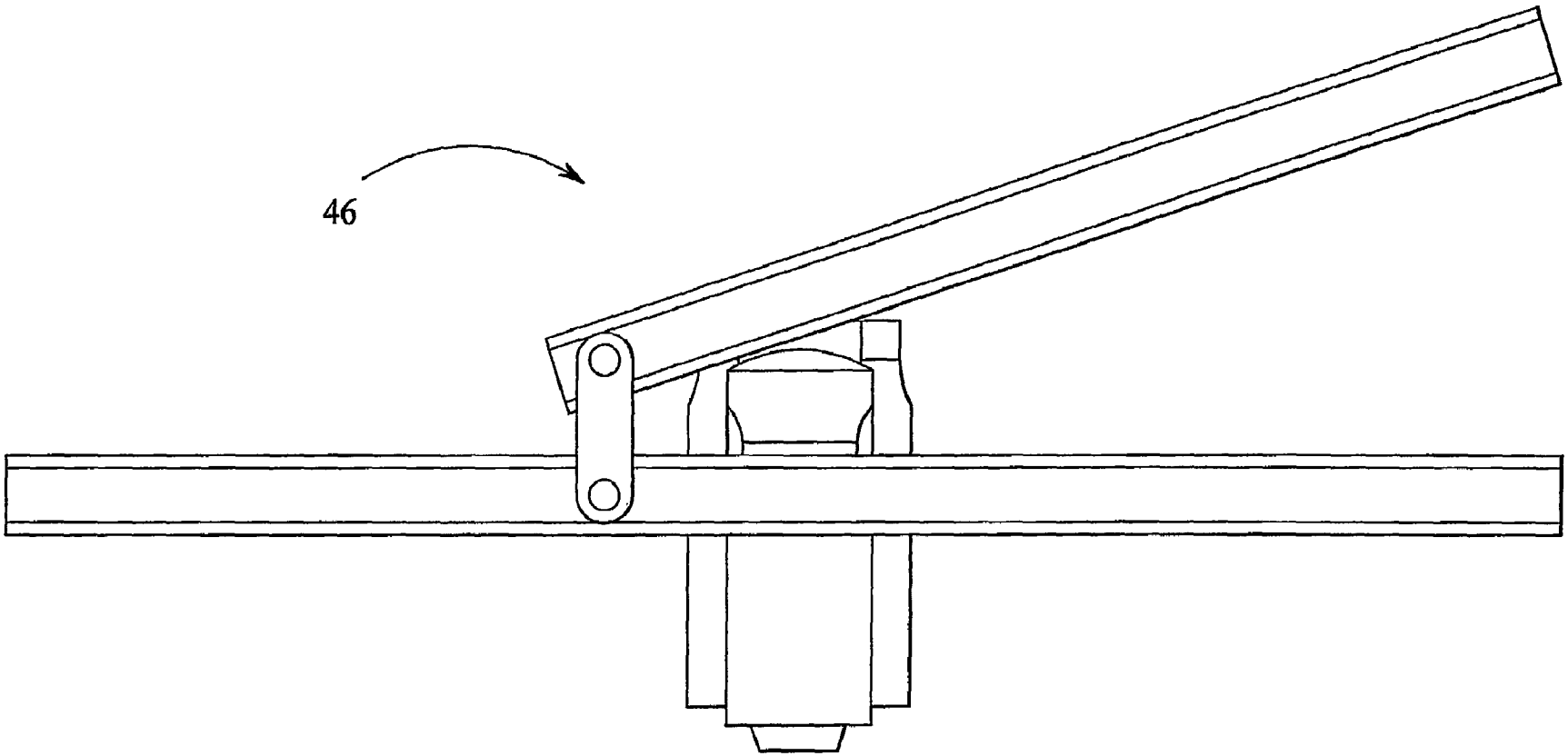

The invention will now be described, by way of example, with reference to the accompanying drawings, in which:

FIG. 1 is an exploded perspective view of a valve assembly of the invention, FIG. 2 is a vertical sectional view through the valve assembly when assembled and engaged in the neck of a container, with locking means shown in a first position, FIG. 3 is a view like FIG. 2, but with the locking means shown in a second position, so that projection means prevent unauthorised removal of the valve assembly, and FIG. 4 shows an insertion tool for use with the valve assembly.

A valve assembly of the present invention is suitable for use with various types of container, for controlling fluid flow into or out of the container, with the fluid being a liquid or a gas, pressurised or non-pressurised. However the valve assembly has particular application to kegs containing beer under pressure and the specific embodiment illustrated in FIGS. 1 to 3, and described in detail below, relates to this use of the valve assembly.

The valve assembly 10 shown in the drawings basically comprises four elements, namely a valve body 11, a valve stem 12, a retainer 13, and locking means in the form of a collet 14. Preferably, apart from sealing means of the valve assembly, all said elements 11 to 14 are made of plastics material.

FIGS. 2 and 3 show the assembled valve assembly in place, in use, at a cylindrical neck 15 of a container in the form of a beer keg 16 in which beer under pressure is to be stored for dispense through the valve in the normal manner, in use.

As shown best in FIG. 1, the valve body 11 is of generally hollow cylindrical form having at its end which is engaged, in use, in the neck 15 a cylindrical flange 17 which, although not shown in FIG. 1, is externally screw threaded at 18 to engage with complementary screw threads on the internal surface of the neck 15 so as to engage the valve assembly with the keg, in use. As can be seen best from FIGS. 2 and 3, the one-piece valve body 11 is provided at a position axially inwardly of said flange 17 with a short external annular flange 19 which is in juxtaposition with an axially directed, facing annular surface 20 at the bottom of the neck 15, with an O-ring seal 21 being trapped between the flange 19 and the surface 20 to seal the body 11 to the neck when the body 11 is engaged therewith.

The part of the valve body 11 extending axially away from said flange 19 is generally cylindrical, but is provided with four angularly spaced cuts or slots 22 which extend, inwardly from its free end, normally to a diametral plane of the valve body. These slots 22 extend almost to the flange 19, and thus divide the part of the valve body 11 remote from the flange 17 into four fingers or legs. However the slots are not equiangularly disposed around this part of the valve body 11. Instead the slots are arranged so that in the illustrated embodiment there is formed a first pair of shorter, fixed facing legs 23 which extend over a certain number of degrees of arc and a second pair of longer, outwardly flexible facing legs 24 which extend over a number of degrees of arc which is less than that for each of the legs 23, so that the legs 24 are narrower than the legs 23, as shown in FIG. 1. Additionally a rectangular opening 25 is formed in each of the fixed legs 23. It will be appreciated that in an unflexed state, as shown in FIGS. 1 and 2, the resiliency of the material of the valve body biases the legs 24 to this rest position shown where this part of the valve body is, as stated, of generally hollow cylindrical form. Finally it will be noted from FIGS. 1 and 2 that the free end edge surface 26 of each of the legs 24 is inwardly chamfered as shown at 27 across the thickness of the leg, for a purpose to be described hereinafter.

The number of valve body legs can be varied as required, as can the number of these legs which are flexible. Thus for example, there could be two, four, six etc such flexible legs.

The valve stem 12 is in the general form of a hollow cylindrical tube which is stepped down internally at approximately half way along its axial length to provide an annular seat 28. At its wider end, the stem 12 has an outwardly directed annular flange 29 and fitted so as to extend partly over this flange and partly within the adjacent internal surface of the stem 12 is a rubber ring seal 30 which is retained in place by an annular clip 31, which may be of metal. The clip terminates short of the outer annular peripheral surface of the seal which extends beyond the outer periphery of the flange 29, and, as can be seen from FIG. 3, this outer peripheral surface of the seal 30 is arranged to engage with an internal tapered annular seat 32 of the valve body 11 when the valve stem is in its normal position once the valve assembly has been engaged with the beer keg as will be described hereinafter.

As shown in FIGS. 2 and 3, a closure member in the form of a plug 33 is slidably received within the larger diameter portion of the tubular valve stem 12, this plug being biased away from the seat 28 formed by the internal stepping of the tubular valve stem 12 by a coiled compression spring 34, one end of which bears against a flat surface of the plug 33 and the other end of which is received against the seat 28. As can be seen from FIGS. 2 and 3, the opposite end of the plug from that which is engaged by the spring 34 is formed with an annular chamfer 35 so as sealingly to engage a generally complementarily shaped surface of the seal 30 positioned within the open end of the valve stem 12, which surface forms a valve seat for plug 33.

It will be appreciated that the exterior surface of the part of the plug 33 below its chamfered sealing surface 35 is provided with suitable grooves 33*a* or the like to enable pressurised fluid within the keg 16 to flow through the valve stem and past the plug 33 when this is moved against its spring 34 so that it is off its seat formed at the seal 30, movement of the plug off its seat and against its bias being, for example, effected in a conventional manner once the beer keg is connected up, in use, to a dispensing tap or the like.

As well as being internally stepped, as described, the outer surface of the valve stem 12 is correspondingly inwardly stepped, as shown in the drawings, to provide an axially directed annular surface 36. Axially spaced a short way from the surface 36 on the exterior surface of the reduced diameter part of the valve stem 12 is an annular flange 37 which defines an axially directed annular surface 38 which faces and is parallel to the flat surface 36, with an annular cylindrical groove defined between said two facing surfaces 36 and 38.

Fitted around the outside of the valve stem 12 is the collet 14 which, as shown in FIG. 1, is in the form of a split ring of two identical halves. Each half of a collet 14 has a main body part defining an outer cylindrical wall surface 39 which is in sliding engagement with the inner surface of the legs 24 as shown in FIG. 2 when, as described, the valve stem 12 is forced away from its position where its seal 30 engages the seat 32. Also, as can be seen from the drawings, the one end of the main body part is formed with an inwardly extending annular flange 40 which engages or is in juxtaposition with the external surface of the larger diameter part of the valve stem 12. The other end of the main body part of the collet is similarly provided with an internally extending annular flange 41, but here the outer free end of the flange is extended radially so that the outer diameter of the flange is substantially equal to the outer diameter of the cylinder partly formed by the legs 24 in their unflexed state, as shown in FIG. 2. Moreover the external junction between the outer cylindrical wall surface 39 and the extended flange 41 is chamfered, as at 42 to match the chamfer 27 of the edge surface 26, for a purpose to be described. Finally with regard to the collet 14, it can be seen from FIGS. 2 and 3 that extending axially from the flange 41 is a cylindrical tail part 43 which has an internal annular projection 44 which is received in, and matches, the annular cylindrical groove defined between the surfaces 36 and 38, thereby serving to retain the collet on the valve stem 12 so that, as will be described, it moves therewith when the valve stem 12 moves axially, as will be described. It will be appreciated that the two collet halves are retained together to define a single annular collet by virtue of these halves being received tightly within the inside of the cylinder defined by the legs 23 and 24 in their unflexed state, shown in FIG. 2.

Finally with regard to the structure of the valve assembly, it can be seen from the drawings that the retainer 13 is in the form of a ring which is retained within the cylindrical part of the valve stem defined by the legs 23 and 24 at a fixed axial position, with its outer cylindrical surface engaging the inner cylindrical surfaces respectively of the legs 23 and 24 and its inner cylindrical surface relatively slidingly engaging the outer cylindrical surface of the larger diameter portion of the valve stem 12. As can be seen from FIGS. 2 and 3, one end of a coiled compression spring 45 engages the annular end surface of the retainer which faces the neck 16, the opposite end of the spring 45 being engaged against the underside of the flange 29 of the valve stem 12. In this way the spring 45 biases the valve stem 12 to its FIG. 3 position where its seal 30 engages against the seat 32.

Preferably, the valve assembly is sold in its FIG. 3 state, and to insert the valve assembly into the beer keg, i.e. to engage the part of the valve body 11 beyond the legs 23 and 24 with the neck 15, a special insertion tool 46 (FIG. 4) is used which is inserted into the top of the body 11 and depresses the valve stem 12 off its seat 32 to the position shown in FIG. 2, against the bias of its spring 45. It can be seen from FIG. 2 that in this depressed position of the valve stem 12 the outwardly extended part of the flange 41 lies outside of the lower part-cylindrical portion of the valve body 11 defined by the longer, flexible legs 24, which are thus, in this state, unflexed from their normal rest position. As previously mentioned, the collet is engaged with, and thus moves axially with the valve stem 12 as the valve stem is depressed by said special insertion tool.

During insertion, the valve assembly as shown in FIG. 2 is thus able to be inserted through the neck 15 and the main part of the valve body 11 received within the interior of the beer keg with the part of the valve body 11 above the legs 23 and 24, as viewed in FIG. 2, being received in the neck 15 and screwed in, with the external threads on the flange 17 engaging with the internal threads on the inside surface of the neck until the position shown in FIG. 2 is reached whereby the valve body 11 is tightly engaged in the neck.

The insertion tool is then removed, and as a consequence the spring 45 forces the valve stem 12 upwardly, as viewed in FIG. 2. Since, as described, the collet moves bodily with the valve stem, it will be appreciated that this collet will also now rise. However as the valve stem begins its upward movement under the force of its spring 45, it will be appreciated that the chamfer 42 of the collet will engage against the chamfer 27 at the respective lower edge surfaces of the legs 24. As described, these longer legs 24 are flexible, and thus as a consequence, as the collet continues to rise with the valve stem 12, under the force of the spring 45, the legs are non-pivotally splayed apart by the upwards movement of the extension of the flange 41 of the collet until the position shown in FIG. 3 is reached where the seal 30 at the top of the valve stem 12 is forced into tight engagement with the valve seat 32 of the valve body 11 and the collet engages the fixed stop formed by the retainer 13. As shown in FIG. 3, in this position the collet has now reached a position inside the legs 24 such that it has splayed them both out to a degree which is sufficient for the 'skirt' formed by the legs now to be unable to pass out through the opening defined by the neck 16. Accordingly by means of the dilated 'skirt' formed by the legs 24, the valve is prevented from flying out of the neck of the keg due to the pressure of liquid therein, if an unauthorised attempt is made to unscrew the valve assembly and remove it from the keg. It will be appreciated that removal is, however, possible by again employing the special insertion tool so as to depress the valve stem and move the collet out of the 'skirt' formed by the legs 24, to the position shown in FIG. 2 where the flange 41 with its chamfer 42 is again disposed outside of the end of the valve stem 12. This allows the natural resiliency of the legs 24 to return them to their FIG. 2 position, whereupon the cylindrical shape defined by said legs is now of a sufficiently reduced diameter to allow it to pass through the opening in the neck and thus enable valve assembly removal to be undertaken by unscrewing the flange 17 from the neck. It will be appreciated from the above that as the fixed legs are shorter than the flexible legs, the movement of the collet affects only the flexible legs, and not the fixed ones, which the external collet flange with chamfer 42 does not reach or only just touches the lower surface thereof.

It will be appreciated that the present invention is equally applicable to a corresponding valve assembly which instead of being screw-threaded into the neck of the container, is locked in place by some form of suitable lug mechanism, as is known with present conventional valve assemblies.

Although as described, only part of the end of the valve body is dilated/expanded outwardly to form the projection means which prevent subsequent passage of the valve assembly out through the opening in the neck, it will be appreciated that the whole of this lower end could instead be expanded outwardly, producing projection means which would prevent such removal. Moreover in an alternative arrangement it could be arranged that the projection means is formed by a member on the lower part of the valve stem 12 being arranged to be expanded outwardly around the outside of the lower part of the valve body 11 when the valve stem 12 moves from its FIG. 2 to its FIG. 3 position, with such member being engaged, for example, with an outside chamfer at the lower end edge surface of the lower cylindrical part of the valve body 11. This could cooperate with a corresponding complementary chamfer on the member so as to expand it outwardly and thus form the projection means around the outside of this lower cylindrical part of the valve body 11, which means then prevent removal of the valve assembly in the same manner as described with the FIGS. 1 to 3 arrangement. In this arrangement the locking means and the projection means are not separate, as with the illustrated embodiment.

The invention claimed is:

1. A valve assembly comprising a body adapted to be engaged in an opening in a container, a valve seat, a closure member biased into engagement with said valve seat to prevent fluid flow, in use, past the valve seat, and being movable against said bias to permit such flow, and locking means movable from a first position, in which it is disposed before engagement of the body in said opening in the container, in use, to a second position once such engagement has occurred, and in which second position of said locking means, non-pivotable projection means prevent passage of the valve assembly through said opening, wherein stop means fixed in the interior of said body are engaged by said locking means in its second position, wherein the stop means is an annular retainer through which a valve stem is slidable to move the locking means from its first to its second position.

2. A valve assembly comprising a body adapted to be engaged in an opening in a container, a valve seat, a closure member biased into engagement with said valve seat to prevent fluid flow, in use, past the valve seat, and being movable against said bias to permit such flow, and locking means movable from a first position, in which it is disposed before engagement of the body in said opening in the container, in use, to a second position once such engagement has occurred, and in which second position of said locking means, non-pivotable projection means prevent passage of the valve assembly through said opening, wherein stop means fixed in the interior of said body are engaged by said locking means in its second position, wherein means biasing a valve stem extend between the valve stem and said stop means.

3. A valve assembly comprising a body adapted to be engaged in an opening in a container, a valve seat, a closure member biased into engagement with said valve seat to prevent fluid flow, in use, past the valve seat, and being movable against said bias to permit such flow, and locking means movable from a first position, in which it is disposed before engagement of the body in said opening in the container, in use, to a second position once such engagement has occurred, and in which second position of said locking means, non-pivotable projection means prevent passage of the valve assembly through said opening, wherein the projection means is separate from the locking means, wherein the projection means is at least part of the body which is splayed outwardly by movement of said locking means to its second position, wherein the body is of cylindrical or generally cylindrical form defining four legs depending from a cylindrical part adapted to be engaged in said opening in said container, a first diametrically opposed pair of legs being longer than a second diametrically opposed pair of legs therebetween, the first pair being flexible and forming said projection means, and the second pair being rigid.

4. A valve assembly as claimed claim 3, wherein the locking means is an annular collet having an outwardly extending radial flange.

5. A valve assembly as claimed in claim 4, wherein the flange has a chamfer which engages the end of the body remote from its end adapted to be engaged in said opening in a container, on moving from its first to its second position.

6. A valve assembly as claimed in claim 5, wherein said end of the body is formed with a complementary chamfer.

7. A valve assembly as claimed in claim 3, wherein the locking means is an annular collet having an outwardly extending radial flange.

8. A valve assembly as claimed in claim 7, wherein the collet has a cylindrical part which is received as a close sliding part which is received as a close sliding fit within a part of the body defined by said four legs, the flange of the collet having an external diameter which is equal to the external diameter which said part of the body has when the collet is in its first position.

9. A valve assembly as claimed in claim 8, wherein in moving from its first to its second position, the collet flange splays outwardly said flexible legs of said first pair of legs but does not reach said shorter rigid legs of said second pair.

10. A valve assembly as claimed in claim 9, wherein movement of the collet from its first to its second position is arrested by a valve stem, which carries said collet, sealingly engaging with a valve seat of the body.

11. A valve assembly as claimed in claim 10, wherein in its second position the collet engages stop means fixed in the interior of the body.

12. A valve assembly as claimed in claim 11, wherein means biasing the valve stem sealingly to engage with a valve seat of the body extend from the stop means to the valve stem.

13. A valve assembly as claimed in claim 3, including an insertion tool adapted to be received in said body so as to hold the locking means in its first position and allow it to move to its second position when the tool is removed.

14. A valve assembly as claimed in claim 3, wherein in said second position of said locking means, the projection means is splayed outwardly to prevent said passage of the valve assembly through said opening.

15. A valve assembly as claimed in claim 3, wherein said projection means is a pair of diametrically opposed flexible legs of the innermost end of the body, in use, dilated by said locking means in said second position thereof.

16. A valve assembly as claimed in claim 3, wherein said valve seat is at one end of a valve stem which fixedly carries said locking means.

17. A valve assembly as claimed in claim 16, wherein said valve stem is biased sealingly to engage with a valve seat of the body.

18. A valve assembly as claimed in claim 17, wherein said valve stem is held off said valve seat of the body against said bias in said first position of the locking means, and sealingly engages with said valve seat of the body in said second position of the locking means.

19. A valve assembly as claimed in claim 3, wherein stop means fixed in the interior of said body are engaged by said locking means in its second position.

20. A valve assembly as claimed in claim 1, wherein in said second position of said locking means the projection means is splayed outwardly to prevent said passage of the valve assembly through said opening.

21. A valve assembly as claimed in claim 1, wherein the projection means and the locking means are on the same component.

22. A valve assembly as claimed in claim 1, wherein the projection means is separate from the locking means.

23. A valve assembly as claimed in claim 22, wherein the projection means is at least part of the body which is splayed outwardly by movement of said locking means to its second position.

* * * * *